US006199263B1

(12) United States Patent
Cholet et al.

(10) Patent No.: US 6,199,263 B1
(45) Date of Patent: Mar. 13, 2001

(54) PROCESS FOR PREPARATION OF AN ARTICLE MADE OF ENAMELED SHEET STEEL BY A DIRECT METHOD

(75) Inventors: Vicent Cholet, Metz; Daniel Vonner, Garche, both of (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 09/045,771

(22) Filed: Mar. 23, 1998

(30) Foreign Application Priority Data

Mar. 21, 1997 (FR) ..... 97 03452

(51) Int. Cl.[7] ..... B05D 7/00

(52) U.S. Cl. ..... 29/527.4; 72/46; 427/156; 427/405; 427/419.2

(58) Field of Search ..... 72/46; 29/527.2, 29/527.4; 427/156, 405, 419.2

(56) References Cited

U.S. PATENT DOCUMENTS 2,569,453 10/1951 Chester et al. .
2,809,907 10/1957 Cramer .
2,983,634 5/1961 Budininkas .
3,753,870 8/1973 Hoffman et al. .

FOREIGN PATENT DOCUMENTS 1 237 493 11/1960 (FR) .
2 020 356 7/1970 (FR) .
2 196 400 3/1974 (FR) .
163050 12/1959 (SU) .

*Primary Examiner*—P. W. Echols
(74) *Attorney, Agent, or Firm*—Oblon, Spivak, McClelland, Maier & Neustadt, P.C.

(57) ABSTRACT

Process using the following stages in the following order:
a) scouring,
b) initial surface treatment in a single operation meeting three criteria relating to resistance to corrosion, lubrication and cleanability,
c) shaping,
d) second so-called nickeling surface treatment,
e) enameling.

With the aid of this order of operations and the criteria defining the initial surface treatment, scouring may be carried out on line on the installations for production of sheet-steel strips.

20 Claims, 1 Drawing Sheet

PROCESS FOR PREPARATION OF AN ARTICLE MADE OF ENAMELED SHEET STEEL BY A DIRECT METHOD

BACKGROUND OF THE INVENTION

1. Field of the Invention

The invention relates to a process for preparation of an article made of enameled sheet.

2. Description of the Related Art

In order to enamel a sheet steel, there are deposited successively on the sheet a "mass" coat of enamel, then a so-called "glaze" coat of enamel.

The mass coat of enamel serves as a setting coat on the sheet.

The glaze coat is the finishing coat.

But a sheet also may be enameled without using a setting coat, therefore without a mass enamel: it is what commonly is called enameling "by a direct method."

In enameling by a direct method, as in any other enameling technique, several coats of glaze enamel also may be superposed.

In order to enamel a sheet by a direct method, by direct application of a glaze coat, the metallic surface to be enameled is prepared so as to obtain, in particular, a good adhesion of the enamel coat to the sheet.

In order to implement an article made of sheet steel enameled in this manner, such as a cooking pot or a casserole, from a cut sheet-steel strip, the following operations are undertaken in the following order: shaping, scouring, surface treatment, enamel-glaze frit coating and firing of the enamel.

Prior to shaping the sheet, it generally is advisable to apply a lubricating agent, for example a coat of oil, and following this operation, it then is advisable to clean the sheet (just prior to scouring).

The sheet which is used for shaping generally already is treated for temporary protection against corrosion (under transport and storage conditions); this surface protective treatment, applied at the conclusion of manufacture of the sheet strips, also may have a lubricating function.

In order to prepare the metallic surface for direct enameling, the metallic surface therefore first is scoured, then treated with a solution containing nickel as a coat-forming cation; this surface treatment also is called "nickeling."

Scouring and surface treatment generally are carried out by immersion or spraying.

In order to obtain a good adhesion and a good surface quality for the enamel, it generally is advisable to perform a deep scouring corresponding to a removal of material in excess of 15 g/m$^2$/face, usually on the order of 25 g/m$^2$/face of surface to be enameled.

This scouring is necessary to create a microrugosity on the surface, facilitating the adhesion of the enamel.

This deep scouring is a drawback to the extent that it generates very significant volumes of sludge to be treated.

As this scrubbing operation is to be carried out after the shaping, it generally is carried out at the enamelers' themselves, who generally do not have adequate installations for treatment of effluents.

The treatment of these scouring sludges therefore represents a very significant handicap.

The purpose of the invention is to mitigate this handicap by moving the scouring operation prior to shaping to the producer of sheet strips itself, which does have efficient and economical installations for treatment of sludges suited to a mass production and also devoted to the treatment of effluents from other operations, such as those of rolling of steel strips.

The document FR 2 196 400 describes a process for preparation of an article made of enameled sheet by a direct method which comprises the following operations in the following order:

- with a view to obtaining a ground surface (to be enameled), the sheet steel is chemically attacked by electrolysis or, according to example 4, a chemical scouring with sulfuric acid is undertaken until removing 21.5 g/m$^2$ of material;
- there is applied to the ground surface an aqueous solution of soluble glass so as to form, after drying, a temporary coat of soluble glass;
- optionally, a coat of wax is applied on the coat of soluble glass;
- it is shaped, in particular by stamping;
- the surface to be enameled is cleaned and washed with water;
- optionally, a nickeling treatment is performed;
- coating with an enamel-glaze frit is performed and the enamel is fired.

According to this document:

- the soluble glass is a material similar to the protective coat for the enameling and so the residues of soluble glass have no detrimental action on the coat for enameling;
- the coat of soluble glass, of 2 to 5 $\mu$m in thickness, also is useful for the protection of the surface with a view to shaping; it makes it possible to improve appreciably the capacity for deep stamping; it therefore has a "prelubricating" function;
- the solutions of soluble glass themselves being used as a cleaning agent, the coat of soluble glass is easily cleanable, in particular following shaping;
- the coat of soluble glass affords a protection against corrosion provided it is itself covered with a coat impervious to moisture, such as the coat of wax cited as an option or such as a protective coat of lubricant (oil).

According to the process described in this document FR 2 196 400, it therefore is seen that in order to stock the scoured sheets prior to shaping without risk of corrosion, while taking advantage of a prelubrication treatment, it is advisable to apply at least two coats on the scoured sheet: a coat of soluble glass and a coat of wax.

The application of these two coats requires two successive treatments.

The present invention also has the purpose of applying, in a single treatment, an easily cleanable coat for temporary protection against corrosion and for prelubrication.

SUMMARY OF THE INVENTION

To this end, the invention has as a purpose a process for preparation of an article made of enameled sheet steel by a direct method, characterized in that it comprises the following operations in the following order:

- a scouring operation followed immediately by a single surface-treatment operation for temporary protection against corrosion and for prelubrication,
- a shaping operation followed by a cleaning,
- a so-called nickeling surface-treatment operation, and an operation for direct enameling, properly speaking, and characterized in that said surface treatment for temporary protection against corrosion and for prelubrication is selected so as to meet the following three criteria, when it is applied after scouring on a bare sheet steel with a thickness of 1 mm and gradation of DC 03 ED or DC 04 ED by reference to EN standard 10209, published in Nov. 1996:

1/ Criterion of resistance to corrosion: it signifies that after 10 cycles in a humidotherm test according to DIN standard 50017, published October, 1982, the surface scoured then treated does not show any trace of red rust.

2/ Criterion of lubrication: it signifies that after stamping in the shape of a flat-bottomed cupel of a flat blank of said sheet steel with a diameter of 90 mm, scoured then treated, stamping without another provision of lubricating agent over a height of 25 mm at the rate of 1.6 mm/s with a die 50 mm in diameter, no breaking of said blank is observed when the blank-clamp force at the edges of said blank is less than or equal to 65 kN.

3/ Criterion for cleaning: it signifies not being able to observe any significant trace of the treatment after cleaning of the surface scoured then treated under the following conditions: first immersion for 3 minutes in a bath brought to approximately (±5° C.) 60° C. containing 35 g/l of sodium metasilicate, 16 g/l of trisodium phosphate and 2 g/l of nitriloacetic acid, then rinsing with tap water at room temperature by immersion for 1 minute, then by spraying of the same water for 0.5 minute.

The invention also may have one or several of the following characteristics:

- the so-called temporary corrosion-protection and prelubrication surface treatment is carried out by application of a uniform coat of oil, by application of a uniform coat of aqueous oil emulsion or by application of an aqueous solution containing, in solution, a fatty alcohol ethoxylate and a corrosion inhibitor.
- the conditions for nickeling are set in order to obtain a deposit ranging between 0.5 and 2.5 g/m$^2$ on the surface of the article to be enameled.
- the period separating the scouring and surface-treatment operation and the shaping operation is in excess of 1 day.

With the aid of the invention, when scouring is undertaken directly on the sheet strip, the surface, scoured then treated in a single operation both for temporary protection against corrosion and for prelubrication, nonetheless retains a sufficient reactivity, after shaping and cleaning, to make the nickeling treatment effective.

In order to scour the sheet, highly efficient industrial installations for scouring sheet strips then may be used advantageously.

This new order of manufacturing operations makes it possible to provide sheets already scoured, suitable for direct enameling following a possible shaping and a simple cleaning, then nickeling treatment; the enameler no longer needs scouring installations and is freed from treatment of the scouring sludges.

DETAILED DESCRIPTION OF THE INVENTION

Figure 1:
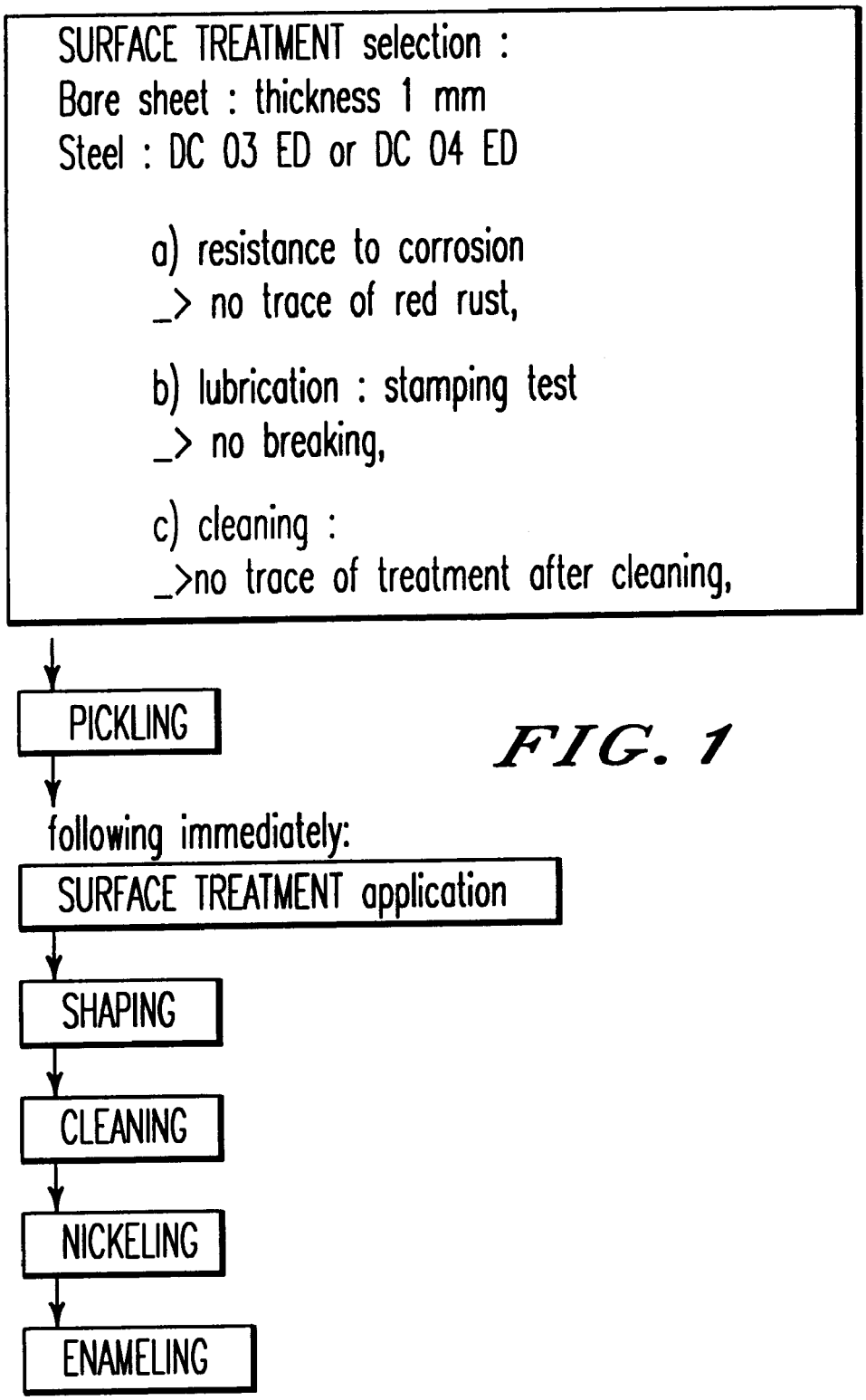
FIG. 1 is a block diagram showing the process of the invention

The invention will be understood better upon reading of the description and the accompanying drawing which is going to follow, given by way of example.

For example, one starts with a strip of sheet steel 1 mm in thickness deriving from a cold-rolling mill, more specifically from the cold-drawing cage.

A steel with a gradation of DC 03 ED or DC 04 ED according to EN standard 10209 is selected.

According to the invention, the sheet strip is scoured, then an initial so-called "temporary corrosion-protection" and "prelubrication" surface treatment is carried out in a single operation.

The composition of the scouring bath and the scouring conditions are known in themselves; for example, sulfuric-acid baths are used and scouring is performed under conditions adjusted to remove approximately 25 g/m$^2$ on each sheet-strip face.

According to the invention, so that the subsequent shaping operation does not degrade the reactivity of the surface afforded by the scouring operation, this initial surface treatment is selected according to the invention so as to meet the following three criteria:

1/ Criterion for resistance to corrosion: it signifies that after 10 cycles in a humidotherm test according to DIN standard 50017, the surface scoured then treated shows no trace of red rust.

Each humidotherm cycle comprises two successive stages: an initial stage for 8 hours at 40° C. under 100% relative humidity and a second stage for 16 hours at room temperature and humidity.

2/ Criterion for lubrication: it signifies that after stamping in the shape of a flat-bottomed cupel of a sheet-steel blank with a diameter of 90 mm, scoured then treated, stamping without another provision of lubrication agent over a height of 25 mm at the rate of 1.6 mm/s with a die 50 mm in diameter, no breaking of said blank is observed when the blank-clamp force at the edges of said blank is less than or equal to 65 kN.

3/ Criterion for cleaning: it signifies not being able to observe any significant trace of the treatment after cleaning of the surface scoured then treated under the following conditions: first immersion for 3 minutes in a bath brought to approximately 60° C. containing 35 g/l of sodium metasilicate, 16 g/l of trisodium phosphate and 2 g/l of nitriloacetic acid, then rinsing with tap water at room temperature by immersion for 1 minute, then by spraying for 0.5 minute.

It is deemed that no significant trace of the treatment after cleaning of the surface can be observed when, on applying a film of water on the cleaned surface, no breaking of the film of water on said surface is observed.

There are several types of so-called "temporary corrosion protection" and "prelubrication" surface treatments which are capable of meeting these three criteria, such as, for example, the application on the scoured surface:

- of an oily composition such as described, for example, in the patent FR 2 562 907; this composition contains: a mixture A comprising 95 to 65% by weight of mineral oil having a viscosity on the order of $15.10^{-6}$ to $30.10^{6}$ m$^2$/s at 40° C. and 5 to 35% of a product comprising a basic calcic alkylaryl sulfonate and an oxidized petrolatum, a calcic salt of oxidized petrolatum or a calcic sulfonate of petroleum, and a mixture B, in a quantity of 0.75 to 5% by weight calculated on the weight of mixture A, containing a higher saturated aliphatic acid having from 12 to 18 carbon atoms, a saturated nonionic moistening agent and a thermally stable phenolic antioxidant agent.

The application of 2 g/m$^2$/face of an oil referenced as V14 from the FUCHS Company is suitable for this purpose.

of an aqueous oil emulsion such as described in the patent FR 2 692 912 from the SOLLAC Company or WO 91/05 033 from the HENKEL Company.

Preferably, after drying, the surface density of said coat is less than or equal to 0.5 g/m$^2$/face.

The application of 0.5 g/m$^2$/face of an emulsion referenced as AQUASAFE 21 or AQUA 2 from the CASTROL Company is suitable for this purpose.

of an aqueous solution containing, in solution, a fatty alcohol ethoxylate and a corrosion inhibitor.

The rinsing and drying operations which accompany the scouring and the initial surface treatment are known in themselves and are not described in detail here.

The scouring and the initial surface treatment advantageously are carried out on line after cold-drawing, at a high speed, for example at the rate of 30 m/min. or more; the scouring time may be reduced considerably with respect to the scouring times of the preparation processes of the prior art: for example, 2 to 25 seconds with respect to usually more than five minutes in the prior art.

The scouring sludges are treated here in an economical manner in installations for treatment of effluents also designed to treat the rolling and cold-drawing effluents.

The scoured and treated sheet (initial treatment) then may be regarded as an intermediate commercial product, made ready for direct enameling.

In fact, this sheet generally is coiled and sent to the enamelers.

With the aid of the initial surface treatment performed after scouring, this sheet resists corrosion during the transport and storage periods, which generally exceed one day and may reach one to three months.

The enamelers then proceed with the following operations in the following order: shaping followed by cleaning, second so-called "nickeling" surface treatment and direct enameling properly speaking.

Shaping is performed with or without lubrication additional to the prelubrication, generally by stamping, and the shaped piece is cleaned, for example, in an alkaline solution.

With the aid of the initial surface treatment, and even if a conventional stamping oil is used for lubrication, the coefficient of friction of the sheet against the shaping tools is lower than with a sheet which might not have been treated according to the criteria indicated above, which facilitates the shaping operation.

After shaping, one then proceeds directly to the second surface treatment of the preparation process according to the invention.

This treatment is of a conventional nickeling type, with a solution containing nickel cations, known in itself for preparing a metallic surface for direct enameling.

The solution contains, for example, sulfate or phosphite anions.

The conditions for nickeling preferably are adjusted in a manner known in itself for obtaining a deposit 0.5 to 2.5 g/m$^2$ on the surface of the article to be enameled.

The nickeling effluents are those which usually are found upstream in direct-enameling installations of the prior art and do not pose any particular treatment problem.

The rinsing and drying operations which accompany the nickeling are known in themselves and are not described in detail here.

The article thus prepared according to the invention now is ready for direct enameling.

The article then is coated with a single coat of glaze enamel which is fired in a manner known in itself.

According to the invention, and even when the shaping is carried out after scouring, an enamel coat is obtained having an adhesion fully comparable to that which would be obtained in a conventional process in which the scouring is performed after shaping; this result indicates that even after shaping, the surface scoured and treated a first time remained sufficiently reactive and/or microrugose to make the nickeling treatment effective.

With the aid of the order of the operations for preparation of the sheet for enameling and the criteria defining the initial surface treatment, a portion of the surface preparation for scouring advantageously is moved, notably the scouring, prior to the shaping: the scouring then may be performed continuously on the strip of sheet directly downstream from the rolling, in large-capacity industrial installations which benefit from large-scale installations for treatment of effluents and sludges.

This surface treatment for "temporary protection" and "prelubrication" is far more simple and effective than the treatment described in the document FR 2 196 400 already cited.

The products of surface treatment used in the initial treatment in general are easily eliminated at the time of cleaning, just after shaping, which is necessary to impart a good surface reactivity in the following stages of the process; the cleaning effluents in general are easy to treat.

EXAMPLE

The following example illustrates the invention.

Starting with a sheet steel for enameling deriving directly from a cold-rolling mill, more specifically from the cold-drawing cage, the following operations are undertaken in the following order:

1/ Scouring of the cleaned sheet in a sulfuric acid solution brought to 90° C. for a period adjusted in order to remove 20 to 25 mg/m$^2$/face.

The high temperature of the scouring bath makes it possible to improve kinetics and therefore productivity.

2/ Initial surface treatment by application in a single operation on the scoured sheet of 2 g/m$^2$/face of a uniform coat of oil referenced as V14 from the FUCHS Company.

3/ After possible storage at room temperature for 1 day to three months, shaping by stamping of the scoured and treated sheet under conventional lubrication, then cleaning at 90° C. for 10 minutes in a solution referenced as OAKITE 19 from the LAPORTE Company.

4/ Second so-called "nickeling" surface treatment by application of a coat of 0.8 to 1.6 g/m$^2$/face of nickel sulfate from a nickel-sulfate solution at 70° C. with pH approximately equal to 2.5.

5/ Direct enameling by application of a frit referenced as L138 from the FERRO Company, firing being performed for about 5 minutes at approximately 820° C.

An article made of enameled sheet is obtained, the enamel coat of which has a surface quality and an adhesion close to that which would be obtained by proceeding as in the prior art, notably according to the same operations but in the following order: 1/ When rolling is completed, initial surface treatment (temporary protection against corrosion and prelubrication)—2/ After possible storage, shaping followed by a cleaning—3/ Scouring—4/ Second surface treatment (nickeling)—5/ Direct enameling.

Obviously, numerous modifications and variations of the present invention are possible in light of the above teachings. It is therefore to be understood that within the scope of the appended claims, the invention may be practiced otherwise than as specifically described herein.

French patent application 97 03452 is incorporated herein by reference.

What is claimed is:

1. A process for the preparation of an enameled sheet steel, comprising:

performing the following steps on a steel sheet in the following order:

scouring followed immediately by treating of a surface of said scoured steel sheet for temporary protection against corrosion and for prelubrication;

shaping of said treated steel sheet followed by cleaning of said surface of said shaped steel sheet;

nickeling of said surface of said cleaned steel sheet; and direct enameling of said surface of said nickeled steel sheet;

wherein said treating for temporary protection against corrosion and for prelubrication meets the following criteria a)–c), when it is applied after scouring on a bare sheet steel with a thickness of 1 mm and gradation DC 03 ED or DC 04 ED by reference to EN standard 10209 (November, 1996):

a) Criterion for resistance to corrosion: the surface of said 1 mm thick bare sheet steel scoured and then treated for temporary protection against corrosion and for prelubrication shows no trace of red rust after 10 cycles in a humidotherm test according to DIN standard 50017 (October, 1982);

b) Criterion for lubrication: after stamping of said 1 mm thick bare sheet steel in a shape of a flat-bottomed cupel of a sheet-steel blank with a diameter of 90 mm, followed by scouring and then treating for temporary protection against corrosion and for prelubrication, further stamping without further lubrication over a height of 25 mm at the rate of 1.6 mm/s with a die 50 mm in diameter, occurs without breaking of said blank when a blank-clamp force on the edges of said blank is $\leqq 65$ kN;

c) Criterion for cleaning: no significant trace of the treatment for temporary protection against corrosion and for prelubrication is observed after cleaning of the surface of said scoured and then treated 1 mm thick bare sheet steel under the following conditions: immersing for 3 minutes in a bath brought to approximately 60° C. containing 35 g/l of sodium metasilicate, 16 g/l of trisodium phosphate and 2 g/l of nitriloacetic acid, then rinsing with tap water at room temperature by immersing for 1 minute in said tap water followed by spraying of the said tap water for 0.5 minute onto said cleaned surface of said 1 mm thick bare sheet steel.

2. The process according to claim 1, wherein the temporary corrosion-protection and prelubrication surface treatment is carried out by application of a uniform coat of oil.

3. The process according to claim 1, wherein the temporary corrosion-protection and prelubrication surface treatment is carried out by application of a uniform coat of aqueous oil emulsion.

4. The process according to claim 1, wherein after drying the surface density of said coat is less than or equal to 0.5 $g/m^2$/face.

5. The process according to claim 1, wherein the temporary corrosion-protection and prelubrication surface treatment is carried out by application of an aqueous solution containing, in solution, a fatty alcohol ethoxylate and a corrosion inhibitor.

6. The process according to claim 1, wherein the nickeling operation provides a deposit ranging between 0.5 and 2.5 $g/m^2$ on the surface of the article to be enameled.

7. The process according to claim 2, wherein the nickeling operation provides a deposit ranging between 0.5 and 2.5 $g/m^2$ on the surface of the article to be enameled.

8. The process according to claim 3, wherein the nickeling operation provides a deposit ranging between 0.5 and 2.5 $g/m^2$ on the surface of the article to be enameled.

9. The process according to claim 4, wherein the nickeling operation provides a deposit ranging between 0.5 and 2.5 $g/m^2$ on the surface of the article to be enameled.

10. The process according to claim 5, wherein the nickeling operation provides a deposit ranging between 0.5 and 2.5 $g/m^2$ on the surface of the article to be enameled.

11. The process according to claim 1, wherein a period separating the scouring and surface-treatment operation and the shaping operation is in excess of 1 day.

12. The process according to claim 2, wherein a period separating the scouring and surface-treatment operation and the shaping operation is in excess of 1 day.

13. The process according to claim 3, wherein a period separating the scouring and surface-treatment operation and the shaping operation is in excess of 1 day.

14. The process according to claim 4, wherein a period separating the scouring and surface-treatment operation and the shaping operation is in excess of 1 day.

15. The process according to claim 5, wherein a period separating the scouring and surface-treatment operation and the shaping operation is in excess of 1 day.

16. The process according to claim 6, wherein a period separating the scouring and surface-treatment operation and the shaping operation is in excess of 1 day.

17. The process according to claim 7, wherein a period separating the scouring and surface-treatment operation and the shaping operation is in excess of 1 day.

18. The process according to claim 8, wherein a period separating the scouring and surface-treatment operation and the shaping operation is in excess of 1 day.

19. The process according to claim 9, wherein a period separating the scouring and surface-treatment operation and the shaping operation is in excess of 1 day.

20. The process according to claim 10 wherein a period separating the scouring and surface-treatment operation and the shaping operation is in excess of 1 day.

* * * * *

UNITED STATES PATENT AND TRADEMARK OFFICE

CERTIFICATE OF CORRECTION

PATENT NO. : 6,199,263 B1
DATED : March 13, 2001
INVENTOR(S) : Cholet et al.

It is certified that error appears in the above-identified patent and that said Letters Patent is hereby corrected as shown below:

Title page,
Item [75], the Inventors' information is incorrect. Item [75] should read:
-- [75] Inventors: Vincent Cholet, Metz; Daniel Vonner, Garche, both of (FR) --

Signed and Sealed this

Eighteenth Day of December, 2001

*Attest:*

*Attesting Officer*

JAMES E. ROGAN
*Director of the United States Patent and Trademark Office*